United States Patent [19]

Willyard, Jr. et al.

[11] Patent Number: 4,691,423

[45] Date of Patent: Sep. 8, 1987

[54] METHOD FOR REMANUFACTURING A COMPRESSOR HOUSING

[75] Inventors: Dewey L. Willyard, Jr., Charlotte; David E. Cline, Concord; David E. Wulfhorst, Denver, all of N.C.

[73] Assignee: Cummins Atlantic, Inc., Charlotte, N.C.

[21] Appl. No.: 824,736

[22] Filed: Jan. 31, 1986

Related U.S. Application Data

[62] Division of Ser. No. 736,664, May 22, 1985.

[51] Int. Cl.[4] ..... B23P 15/00; B23P 7/00

[52] U.S. Cl. ..... 29/156.4 R; 29/402.06; 29/402.08; 29/447; 415/206

[58] Field of Search ..... 29/156.4 R, 157, 401.1, 29/402.3, 402.5, 402.6, 402.7, 402.8, 447; 415/196, 197, 206, 202, 203, 219 C, DIG. 3

[56] References Cited

U.S. PATENT DOCUMENTS

| | | | |
|---|---|---|---|
| 1,608,547 | 11/1926 | Clark | 415/196 X |
| 3,372,452 | 3/1968 | Firth et al. | 29/447 X |
| 3,664,001 | 5/1972 | Pilarczyk | 29/156.4 R |
| 3,758,227 | 9/1973 | Pollak et al. | 415/206 X |

FOREIGN PATENT DOCUMENTS

| | | | |
|---|---|---|---|
| 368160 | 3/1932 | United Kingdom | 415/DIG. 3 |

*Primary Examiner*—Howard N. Goldberg
*Assistant Examiner*—Ronald S. Wallace
*Attorney, Agent, or Firm*—W. Thad Adams, III

[57] ABSTRACT

A compressor housing having an integrally formed throat, such as is used on internal combustion engines and specifically diesel engines, may be repaired or modified by removal of the throat portion and replacement of that portion with a separate throat insert selected from a variety of throat inserts for a given size compressor housing and for various specifications.

2 Claims, 9 Drawing Figures

FIG. 2
PRIOR ART
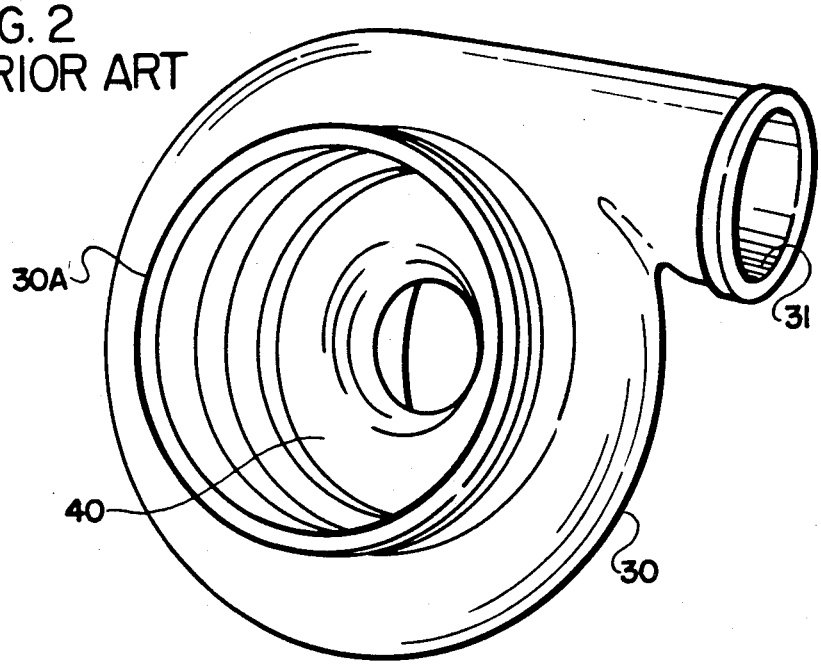
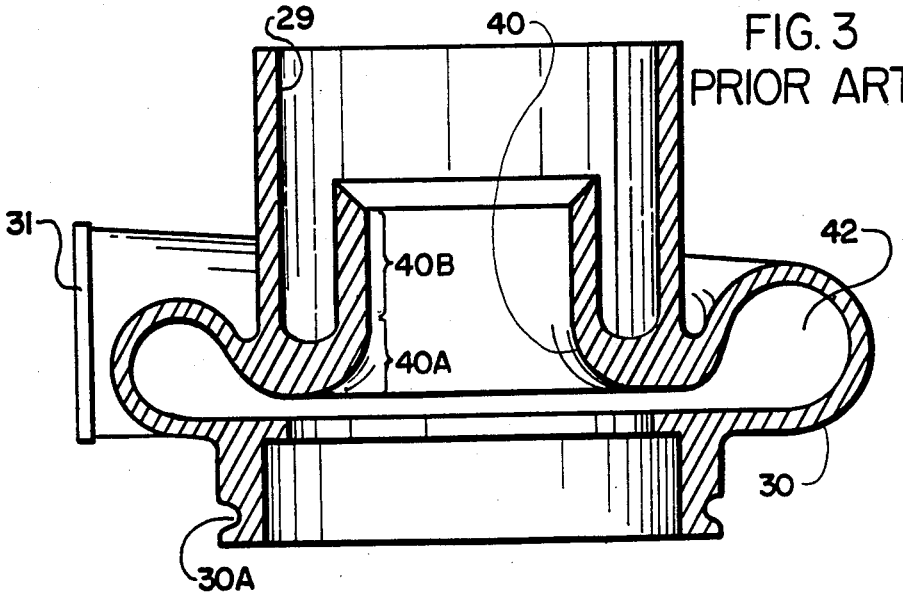
FIG. 3
PRIOR ART

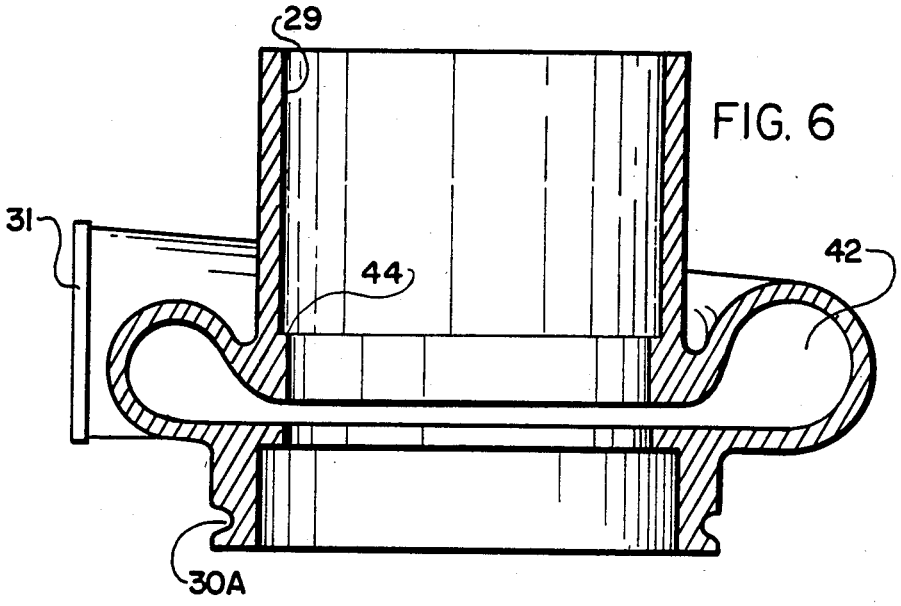
FIG. 6
FIG. 7
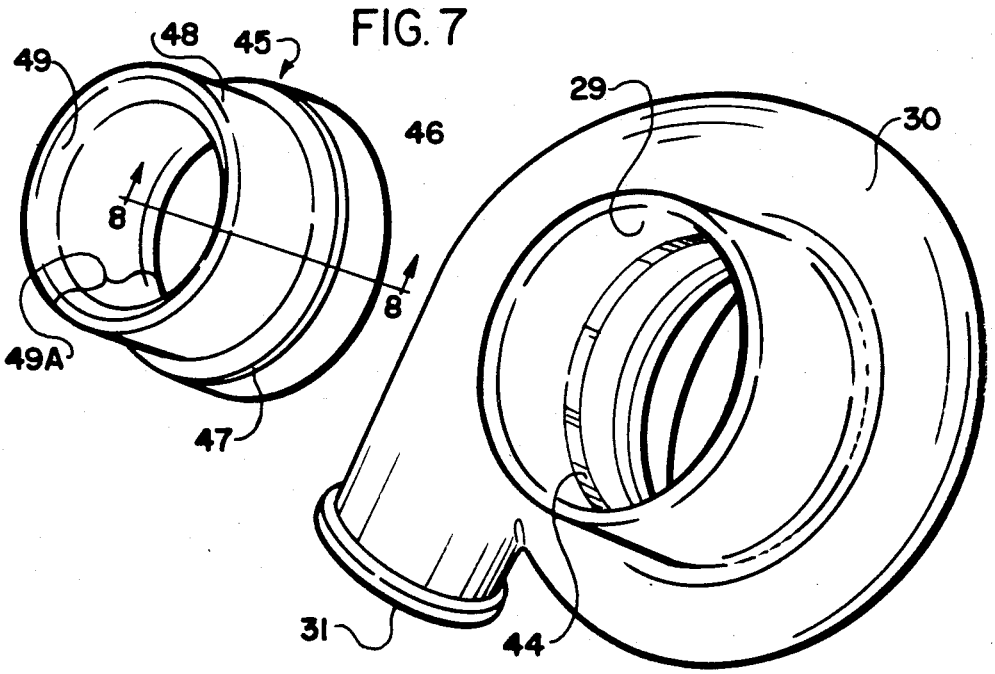

FIG. 8
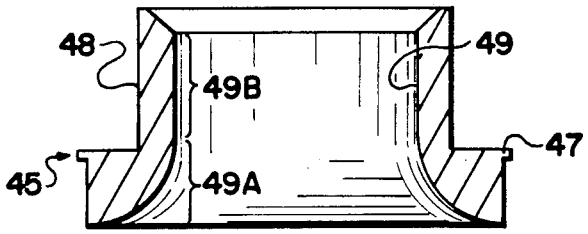
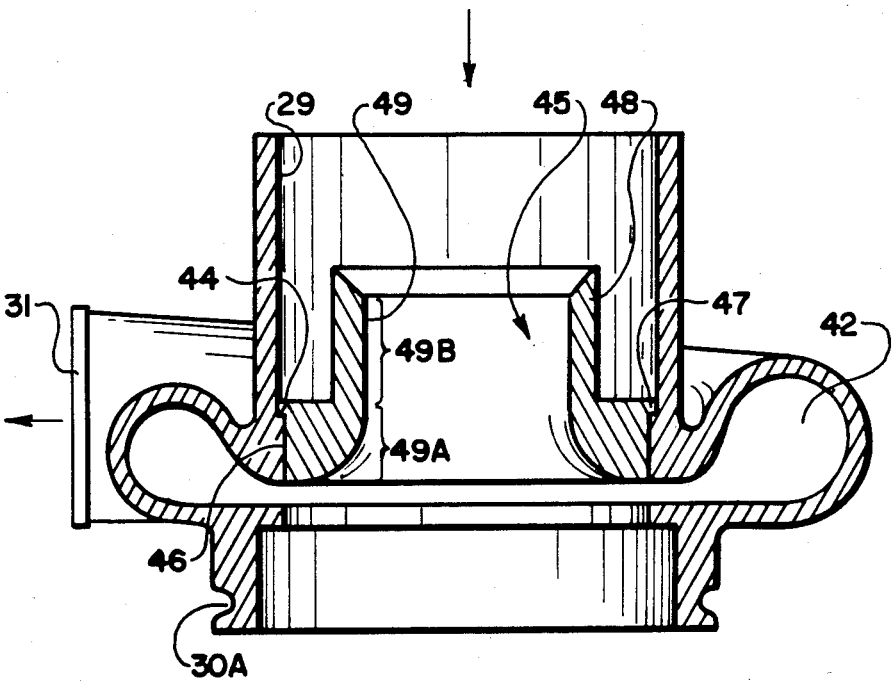
FIG. 9

METHOD FOR REMANUFACTURING A COMPRESSOR HOUSING

This application is a division of application Ser. No. 736,664, filed 5/22/85.

TECHNICAL FIELD AND BACKGROUND OF THE INVENTION

This invention relates to a compressor housing modification for the compressor portion of a turbocharger. The particular embodiment disclosed in this application relates to a compressor housing portion of a turbocharger such as is used on large diesel engines. However, the invention disclosed in this application can be applied to compressor housings used on other types of internal combustion engines. For purposes of illustration, the invention is described in this application in terms of a preexisting compressor housing manufactured with an integrally-formed throat. As described herein, the integrally-formed throat is removed and replaced with a separate throat insert which can be replaced and which can have different throat sizes for a given sized compressor housing.

A turbocharger increases the power available to an integral combustion engine by making use of the dynamic energy present in the rapidly moving exhaust gases which are removed from the compression chamber of the engine during each cycle. The exhaust gases are directed through a turbine and against a turbine wheel. The turbine wheel has blades which convert the energy in the exhaust gases into rotary motion of the wheel and the shaft on which the wheel rotates. On the other end of the same shaft is a compressor wheel mounted for rotation in a compressor housing. The rotation of the compressor wheel takes intake air being conveyed to the air intake manifold of the engine and compresses it. The energy added to the air during the compression process is released when the air is mixed with fuel and ignited, thereby increasing the available power output of the engine.

The shaft on which the turbine wheel and compressor wheel are mounted rotates at extremely high speeds. Accordingly, the shaft and wheels must be very delicately balanced and aligned relative to the turbine housing and compressor housing, respectively. For this reason, the shaft is very carefully mounted on bearings which not only control the rotation of the shaft but also the axial movement of the shaft between the compressor housing and the turbine housing. To achieve maximum efficiency, the shape of the turbine wheel and the compressor wheel must very closely correspond to the adjacent surfaces of the turbine housing and compressor housing, respectively. This is a particularly critical factor with regard to the compressor housing and the compressor wheel. In order to achieve a smooth, efficient and relatively quiet transfer of energy from the rapidly rotating compressor wheel to the air being fed to the engine, the cross-section of the compressor wheel and the corresponding cross-sectional surface of the compressor housing must be substantially the same. The compressor wheel is spaced-apart only so far as is necessary to prevent actual contact between the compressor wheel and the compressor housing. The portion of the compressor housing which corresponds to the cross-sectional shape of the compressor wheel is called the throat. The throat is an annular orifice which reduces in diameter as its surface moves away from the compressor wheel. In cross-section, its shape generally resembles that of a trumpet bell.

Occasionally, the bearings on which the compressor wheel shaft is mounted become loose and permit the compressor wheel to move into actual contact with the throat of the compressor housing. The rapid rotation of the compressor wheel quickly destroys the uniform shape of the throat. In some cases, the damage is relatively minor. In such instances, prior art repair of the compressor housing involves remachining the surface of the throat to restore to throat to its desired shape. However, if the damage to the throat involves deep scars or gashes, remachining it not possible because the remaining thickness of the throat would be below minimum specifications. Therefore, prior art methods of repairing compressor housings involve first a determination of the extent of damage to the compressor housing throat. If the damage is relatively minor, the throat surface is remachined as described above. If the damage is substantial, the compressor housing is scrapped even though the remainder of the compressor housing is completely satisfactory for continued use. Even when compressor housings can be remanufactured by remachining the throat, repaired compressor housings must be stocked in a wide variety of compressor housing types and throat diameters.

The necessity to maintain a large inventory of different sizes increases substantially the expense of repairing or overhauling engines since very often the repairs must be made on a emergency basis and there is no time to order correctly sized compressor housings from a centrally located parts depot. There has long existed a need for a way in which to use compressor housings, which have damaged throats but are otherwise in good condition and, also, a way to reduce substantially the number of compressor housings required to be carried in inventory in repair and overhaul facilities. The invention described in this application achieves both objectives in a novel manner.

SUMMARY OF THE INVENTION

Therefore, it is an object of the invention to provide a compressor housing having a replaceable inlet throat which can be removed if damaged or if a change in inlet throat size is desired, and replaced with another inlet throat. It is another object of the invention to provide a compressor housing without an integrally-formed throat which can be inventoried in relatively small numbers and, when installed, be mated with a replaceable inlet throat of one one of wide variety of required sizes.

It is another object of the present invention to provide a method of manufacturing a compressor housing which permits a separately formed inlet throat to be mated to and removed from the compressor housing as required, and replaced.

These and other objects of the present invention are achieved in the preferred embodiment disclosed below by providing a compressor housing having a centrally-disposed through bore in fluid communication with a fluid conduit, and a separately formed inlet throat for being positioned in the bore and secured to the fluid conduit of the compressor housing for providing a compressor housing having a replaceable inlet throat which can be removed if damaged, or if a change in inlet throat size is desired, and replaced. According to a preferred embodiment of the invention, the circumference of the bore is undersized relative to the circumference of the inlet throat, with the degree of undersizing being predetermined to permit the fluid conduit to be heated to expand the circumference of the bore to permit insertion of the inlet throat in the bore to form an interference fit between the inlet throat and the fluid conduit when the fluid conduit has cooled.

According to the method described in this application, a compressor housing is manufactured by first forming a ring-shaped fluid conduit having a centrally disposed bore in fluid communication therewith and an outlet therein; forming a separate inlet throat adapted to be positioned within the bore and secured to the fluid conduit in fluid communication therewith; and positioning the inlet throat in the bore and securing the inlet throat in the fluid conduit.

BRIEF DESCRIPTION OF THE DRAWINGS

Some of the objects of the invention have been set forth above. Other objects and advantages of the invention will appear as the description of the invention proceeds when taken in conjunction with the following drawings, in which:

FIG. 2 is a perspective view of a prior art compressor housing having an integrally-formed throat;

FIG. 3 is a cross-sectional view of the prior art compressor housing shown in FIG. 2;

FIG. 6 shows the cross-section of the compressor housing shown in FIG. 5, after the step of machining away the walls of the air inlets somewhat to form an annular, integrally-formed seat;

FIG. 7 is a perspective view of a compressor housing and a replaceable throat insert, showing the manner of insertion of the insert in the housing;

FIG. 8 is a cross-section taken along lines 8—8 of FIG. 7 of the replaceable throat insert according to the invention; and FIG. 9 is a cross-sectional view of a compressor housing according to the present invention showing the replaceable throat insert in position within the housing.

DESCRIPTION OF THE PREFERRED EMBODIMENT

Figure 1:
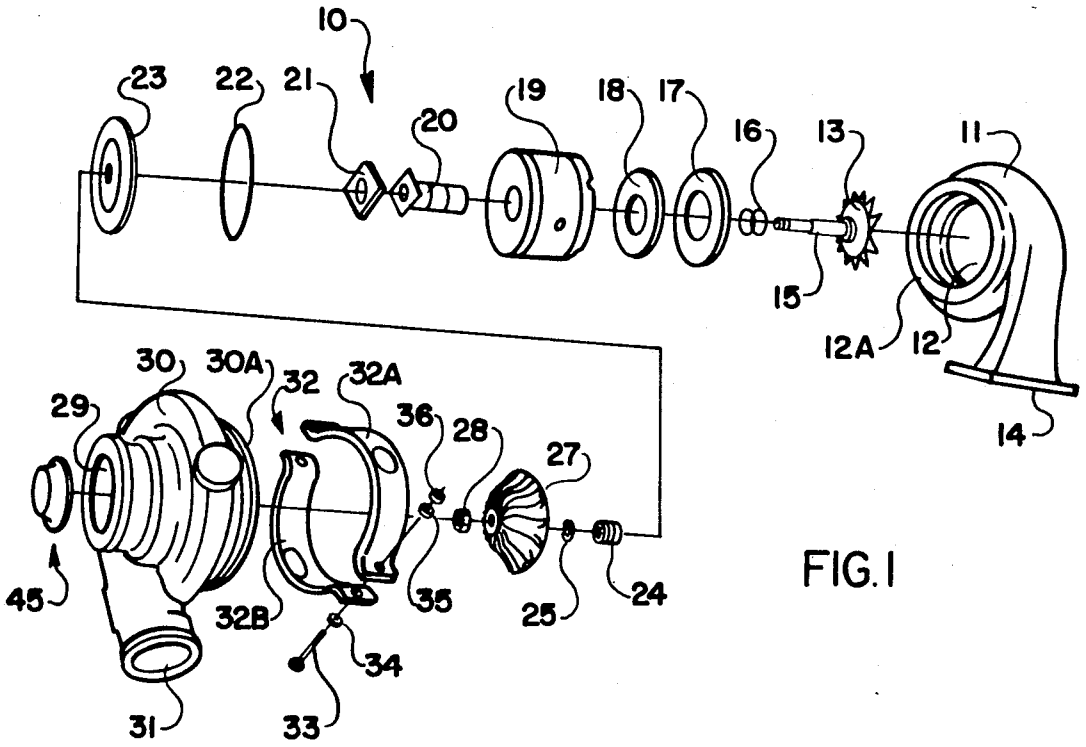
FIG. 1 is an exploded view of a turbocharger of the type wherein a compressor housing according to the present invention is used.

Referring now specifically to the drawings, a turbocharger in which a compressor housing according to the present invention is used is illustrated in FIG. 1 and generally designated by reference numeral 10. The turbocharger is shown in an exploded view for clarity and ease of description. Exhaust gases from an engine (not shown) enter the turbine through a concentric inlet 12 and impinge upon a concentrically mounted turbine wheel 13. The exhaust gases exit turbine 11 centrifugally through an exhaust gas outlet 14. Turbine wheel 13 is mounted on one end of a shaft 15. Oil seals 16, a heat shield 17 and an insulation ring 18 are mounted on shaft 15 adjacent turbine wheel 13. Shaft 15 is then mounted concentrically within a bearing housing 19. Shaft 15 rotates within a turbocharger bearing 20 and a turbocharger bearing insert 21 An O-ring 22 and an oil seal plate 23 are likewise mounted on shaft 15. An oil seal sleeve 24 and an oil control ring 25 are mounted on shaft 15 on the side of the oil seal plate 23 remote from turbine wheel 13. Then, a compressor wheel 27 is mounted in shaft 15 and secured thereto by a rotor nut 28. Compressor wheel 27 is mounted within a concentric bore 29 in a compressor housing 30.

The turbine housing 11 and compressor housing 30 are secured together by means of a V band clamp 32 formed of two substantially semi-circular clamp members 32A and 32B which are secured together on opposite sides by means of a suitably sized bolt 33 cooperating with washers 34 and 35, and a nut 36. V band clamp 32 engages an integrally-formed, annular flange 12A on turbine housing 12 and an integrally-formed, annular flange 30A on compressor housing 30, thereby holding the entire turbocharger 10 together.

A throat insert 45 is positioned within the compressor housing 30, as will be described in detail below. Air at atmospheric pressure enters bore 29 and is boosted to a predetermined high pressure by the rotation of compressor wheel 27. The pressurized air exits the compressor housing 30 centrifugally through an outlet 31 which is normally connected to the air intake manifold of the diesel engine (not shown).

As described earlier, movement of shaft 15 in the axial direction towards either turbine housing 11 or compressor housing 30 is prevented by adjustment within the bearing housing 19. As wear occurs, movement of shaft 15 in the axial direction can cause compressor wheel 27 to contact adjacent surfaces of compressor housing 30.

Referring now to FIGS. 2 and 3, inlet throat 40 according to the prior art is integrally formed with, and defines a concentric, a decreasing housing 30. One portion of the inner surface of inlet throat 40 defines a curved wall portion 40A, and the other end terminates in an annular, straight cylindrical wall portion 40B to which a suitably sized air inlet conduit (not shown) is attached. Air enters inlet 29, is compressed by the rotation of compressor wheel 27 and is conveyed into an encircling fluid conduit 42 and centrifugally accelerated out of compressor housing 30 through compressor outlet 31.

Figure 4:
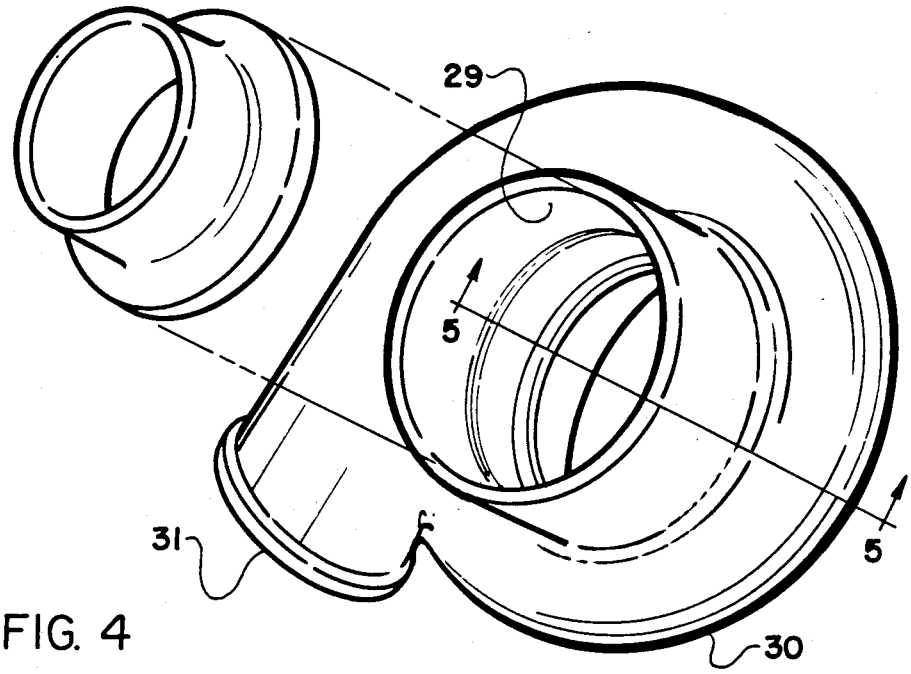
FIG. 4 is a perspective view of a compressor housing, from the opposite side shown in FIG. 2, wherein the integrally-formed throat has been cut from the compressor housing and removed.

The compressor wheel 27 rotates in closely spaced-apart relation to the surface portion 40A of inlet throat 40. As described above, if compressor wheel 27 contacts inlet portion 40A, substantial damage is done to the surface. Therefore, referring now to FIG. 4, in the invention according to this application, the ingtegrally-formed inlet throat 40 is cut by a lathe or some other suitable means from within inlet 29 and discarded. The portion of compressor housing 30 defining the sidewalls of inlet 29 are used to position the compressor housing concentrically on the lathe for removal of inlet throat 40 since inlet throat 40 and air inlet 29 are concentric with each other.

Figure 5:
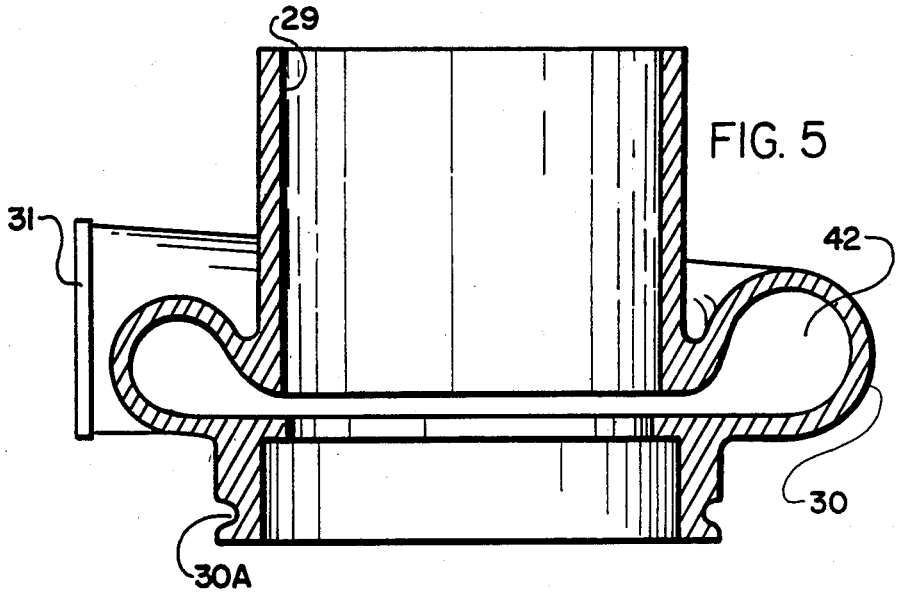
FIG. 5 is a cross-sectional view taken substantially along lines 5—5 in FIG. 4 showing the structure of the compressor housing after removal of the integrallyformed throat.

After removal of inlet throat 40, compressor housing 30, in cross-section, appearrs as is shown in FIG. 5. As is apparent, air inlet 29 now comprises a cylindrical through bore from one axial end of compressor housing 30 to the other.

Referring now to FIG. 6, the inner sidewalls of compressor housing 30 defining air inlet 29 are machined away to form an annular integrally-formed seat 44 within air inlet 29.

Referring now to FIG. 7, a separate, replaceable inlet throat 45 is provided. Inlet throat 45 has an enlarged, annular base 46 with a small, outwardly protruding annular lip 47 thereon. The remaining length of inlet throat insert 45 comprises a mounting collar 48 having outer sidewalls of reduced diameter. A through bore is defined by the inner, cylindrical sidewalls of inlet throat insert 45. As can best be seen by reference to FIG. 8, the inner walls of inlet throat insert 45 defining the through bore comprise a curved wall portion 49A and a straight wall portion 49B. The throat insert 45 can be machined or otherwise suitably formed of aluminum or another suitable metal.

Referring now to FIG. 9, inlet throat insert 46 is positioned within the bore defined by the inner walls 49 of inlet throat insert 45. The lip 47 mates with the integrally-formed seat 44 to provide proper placement and alignment of inlet throat insert 45 within inlet 29.

While it is possible to use a number of different securing methods, it is believed preferable to secure inlet throat insert 45 within inlet 29 by means of an interference fit. This fit can be achieved in a number of different ways. However, by whatever precise method achieved, the circumference of the mounting portion of the bore 29 defined by the inner walls of compressor housing 30 is slightly undersized relative to the outer circumference of base 46 of insert 45. Insertion and proper mounting are achieved by relative heating and/or cooling of the respective parts to permit assembly. For example, compressor housing 30 can be heated to expand slightly the circumference of bore 29. Inlet throat insert 45 is inserted within bore 29 and, when the compressor housing 30 cools, the circumference of bore 29 decreases forming an interference fit by which the inlet throat insert 45 is securely mounted. The interference fit can also be achieved by cooling inlet throat insert 45 relative to compressor housing 30, or, by heating compressor housing 30 and simultaneously cooling inlet throat insert 45 to permit insertion of inlet throat insert 45 within bore 29.

By using this mounting method, inlet throat insert 45 can be removed by repeating the process of heating and/or cooling described above. In addition to the substantial economies achieved by permitting reuse of the undamaged portions of the compressor housing 30, further savings can be achieved because of the need to inventory only a relatively few of the compressor housings. Rather, the much less expensive inlet throat inserts 45 can be manufactured in a wide variety of sizes. The only dimensions that need be uniform from size to size is the dimension of the base 46 and lip 47, to permit insertion of differently sized inlet throat inserts 45 within the same sized compressor housing bore 29.

A compressor housing having a replaceable inlet throat is described above. Also described is a method of manufacturing a compressor housing having a replaceable inlet throat insert and a method of remanufacturing a compressor housing having an integrally-formed inlet throat to accommodate a replaceable inlet throat insert. Various details of the invention may be changed without departing from its scope. Furthermore, the foregoing description of the preferred embodiment according to the present invention is provided for the purpose to illustration only and not for the purpose of limitation the invention being defined by the claims.

We claim:

1. A method of remanufacturing an air compressor housing having an integrally-formed inlet throat comprising a radially in wardly spaced annular collar portion nested within a radially outwardly spaced air inlet portion of the compressor housing, comprising the steps of:

(a) machining away the integrally-formed inlet throat from the interior sidewall of the air inlet portion of the compressor air compressor housing to leave a radially inwardly disposed annular seat on the walls of the housing defining the bore;

(b) forming a separate inlet throat insert comprising a radially inwardly spaced annular collar portion integrally connected with a case portion and adapted to be telescopically positioned within the bore of said compressor housing, said insert having seating means formed around the periphery of the base portion for mating cooperation with the seat on the interior sidewall of the housing; and (c) telescopically positioning said inlet throat insert in the bore of the compressor housing with the annular collar portion nested with and spaced radially outwardly from, the air inlet portion of the compressor housing and securing the inlet throat insert to the compressor housing in mating cooperation with the seat on the interior sidewall of the housing.

2. A method of remanufacturing a compressor housing according to claim 1 and including the further steps of forming the circumference of said inlet throat insert in oversized relation to the circumference of the portion of said fluid conduit defining the bore, the degree of oversizing being predetermined to permit said fluid conduit to be heated to expand the circumference of the bore to permit insertion of said inlet throat insert in the bore to form an interference fit between the inlet throat insert and said fluid conduit when the fluid conduit has cooled.

* * * * *